United States Patent [19]

Outlaw

[11] 4,257,589

[45] Mar. 24, 1981

[54] ABDOMINAL EXERCISE DEVICE

[76] Inventor: Homer G. Outlaw, 855 N. Carrollton, Apt. 8, Baton Rouge, La. 70806

[21] Appl. No.: 38,726

[22] Filed: May 14, 1979

[51] Int. Cl.[3] ..... A63B 69/00; A63B 69/20

[52] U.S. Cl. ..... 272/93; 272/76; 273/58 C

[58] Field of Search ..... 272/76, 77, 78, 93, 272/117; 273/58 C, 95 A, 40, DIG. 20

[56] References Cited

U.S. PATENT DOCUMENTS

| | | | |
|---|---|---|---|
| 735,132 | 8/1903 | McCutchen | 273/40 X |
| 773,167 | 10/1904 | Spink | 272/77 X |
| 2,319,917 | 5/1943 | Bruneau | 273/40 |
| 2,634,977 | 4/1953 | Hunter | 273/40 |
| 2,670,204 | 2/1954 | Powell | 273/40 |
| 4,077,624 | 3/1978 | Feaser | 272/76 |

FOREIGN PATENT DOCUMENTS

| | | | |
|---|---|---|---|
| 774181 | 9/1934 | France | 272/77 |

*Primary Examiner*—George J. Marlo

*Attorney, Agent, or Firm*—Staas and Halsey

[57] ABSTRACT

A method and apparatus of using a conventional bowling ball for toughening up a person's stomach muscles comprises obtaining a medium weight bowling ball of conventional type, making a small bore hole therein, attaching an adjusting component to the ball by using the small bore hole, attaching one end of a suspension cord to the adjusting component and attaching the other end of the suspension cord to an overhead structure by means of an eye, hook, or clamp attachment mountable on a doorframe or the like, and then pushing the ball away from a person's body and allowing it to swing smartly back against one's stomach. The adjustment component attached to the ball may be an eye with the lower end of the suspension cord tied thereto, or may be a handle and cleat adjustment structure affixed to the ball. With the latter, the height of the ball can be readily adjusted to a given person's stomach height by winding or unwinding the suspension cord around the cleats.

4 Claims, 5 Drawing Figures

FIG. 1.
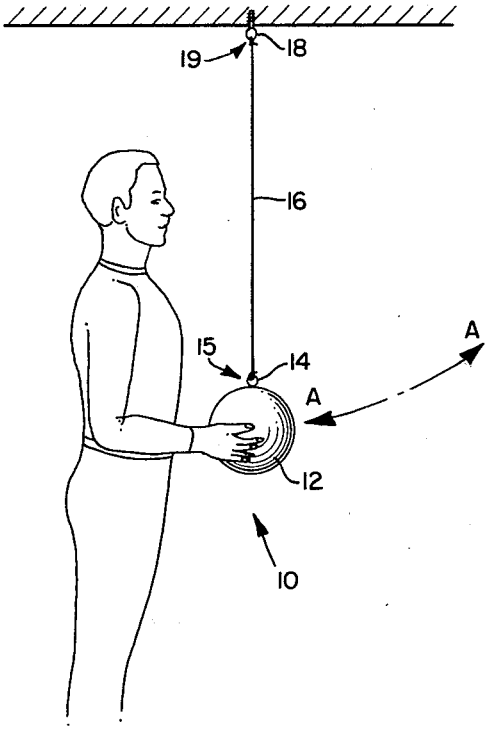
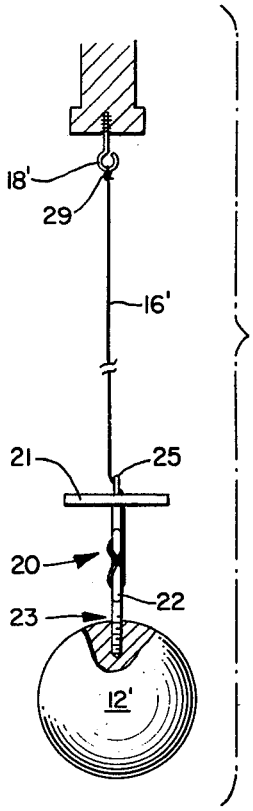
FIG. 2.
FIG. 3.
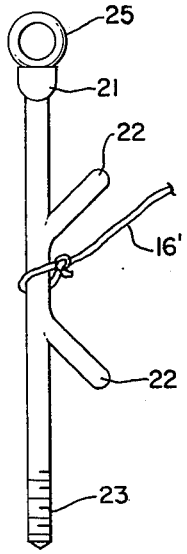
FIG. 4.
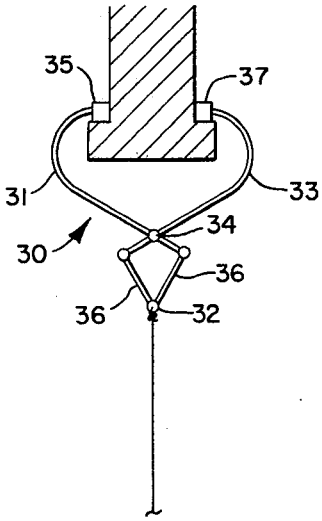
FIG. 5.
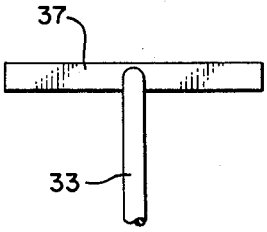

ABDOMINAL EXERCISE DEVICE

BACKGROUND OF THE INVENTION

1. Field of the Invention

This invention relates generally to an exercise device and especially one for use in toning up a person's abdomen.

2. Description of the Prior Art

The common problem with known type exercise devices is that they are not designed especially for toning up a person's abdomen.

Another common problem of known prior art devices is that they provide structure which may be struck, and which may be suspended for pivotal movement in many directions, but in most cases are relatively complex and expensive.

Another problem with most known type exercise devices which have adjustable structure for varying the distance between the operating portion of the device and some overhead support structure, is that the adjusting mechanism is either relatively complicated, or else is not very secure.

Existing prior patents which may be pertinent to this invention are as follows:

| INVENTOR | PATENT NUMBER | DATE GRANTED |
|---|---|---|
| Byron | 815,677 | March 20, 1906 |
| Aumann | 892,388 | July 7, 1908 |
| Sandeberg | 1,512,367 | October 21, 1924 |
| Richards et al. | 1,679,174 | July 31, 1928 |
| Irby | 3,724,845 | April 3, 1973 |
| Lichterman | 4,050,693 | September 27, 1977 |
| Feaser | 4,077,624 | March 7, 1978 |

None of the above prior art patents offers the new and novel featues of subject invention.

SUMMARY OF THE INVENTION

An object of the present invention is to provide an easily usable exercise device for developing and toning up a person's stomach or abdomen muscles.

Another object of this invention is to provide an exercise device which utilizes a conventional type bowling ball for the main portion of the device. In addition, readily adjustable support and suspension structure is used with a bowling ball to permit flexibility and convenience of use.

A further object of this invention is to provide a bowling ball component exercise device having a handle and cleat structure in association with a suspension cord for permitting quick and ready adjustment of the height of the ball for different persons using the device.

A still further object of this invention is to provide a readily attachable and removable overhead frame attachment clamp for supporting the suspension cord for a bowling ball component exercise device.

One of the big features of subject invention is that a conventional, easily obtainable, bowling ball provides the main component of the device. A ball of approximately 16 pounds in weight has been found to be preferable, but ones of lighter or heavier weight may be used. Having obtained a suitable bowling ball, a hole is appropriately drilled or made in the ball for reception of either an adjustment and support eye/hook, or a support handle and adjustment cleat structure.

The other basic component of the device is a support cord or rope which can be appropriately tied to the adjustment structure as affixed to the ball, and then fastened by a readily removable knot to an eye fastened to an overhead such as a ceiling, doorsill, and the like. Then by removing or untying the knot, either on the overhead hook or on the structure affixed to the ball, a quick and simple adjustment for a particular individual person, i.e., at approximately stomach height, can be made. With the cleat type handle and adjustment structure, the support cord can be easily wrapped around or removed from the cleat to shorten or lengthen the support cord.

Another embodiment of the device utilizes a clamp-type doorframe attachment structure for fastening to the upper end of the support rope, said clamp being quickly and easily attached to a doorframe for use of the overall exercise device, and then just as quickly and easily removed therefrom for portability and relocation of the device.

The method of using a bowling ball for a stomach muscle toning-up device is also part of subject invention.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a first embodiment of the exercise device of this invention as in use;

FIG. 2 is a front elevational view showing another embodiment of subject invention;

FIG. 3 is an enlarged side elevational view of the handle and adjustment cleat per se of the embodiment of FIG. 2;

FIG. 4 is an end elevational view of a support rope upper attachment structure modification; and FIG. 5 is a side view of the doorframe engaging bar of the FIG. 4 modification.

DESCRIPTION OF THE PREFERRED EMBODIMENT

Referring to FIG. 1 of the drawings, reference numeral 10 indicates in general the exercise device of this invention as in use. The first embodiment, shown in FIG. 1, is the simplest one of subject invention. In this embodiment, a conventional bowling ball 12 of approximately 16 pounds in weight is used. A suitable eye 14 is appropriately affixed to the bowling ball and a support cord or rope 16 is used to suspend same from an overhead, such as a ceiling or the like. As shown, another eye 18 is screwed into the ceiling to support the exercise device. Appropriate knots 15 and 19 are used to attach the cord at each end to the respective eyes. Either one or the other, or both of the knots, should be of the type which can be easily untied, to permit a desired adjustment of the ball 12 relative to the stomach of a user.

Of course, if the device is to be used by one and the same person at all times, the cord 16 may be prefabricated for a particular length to accommodate that particular user and, in that case, permanent loops may be provided in the ends of the cord, and hooks substituted for eyes 14 and 18, and the knot tying requirement eliminated altogether. However, either system offers a relatively inexpensive way in which to suspend the converted bowling ball into the stomach muscle exercise device of this invention.

FIGS. 2 and 3 show another embodiment, which is the preferred one of the invention, wherein a top hook 18' is attached to the overhead ceiling or doorway and a permanent loop 29 provided at the upper end of support cord 16'. A combination handle and cleat structure 20 is used with the lower end of cord 16' to provide the adjusting feature of this embodiment.

Reference numeral 21 indicates the handle, 22 indicates the cleat structure, and 23 indicates the threaded attachment portion. An eye 25 functions as a cord guide.

FIG. 3 shows the cleat adjusting structure in somewhat enlarged form. Normally an attachment guide eye 25 will be provided at the middle top of the handle portion 21. This eye, of course, is used to receive and guide the lower end of the suspension and support cord 16'. A threaded end 23 of the body 25 of the cleat adjustment structure is screwed into a hole appropriately made in the bowling ball. The lower end of cord 16' is attached to the middle of body 23, and the cleat portion 22 is used for winding up the extra length of support cord 16' in order to position the ball 12' at the desired height of a user's stomach. The handle 22 provides a hand grip while the proper adjustment of the ball height is being made. The handle can also be used to swing the ball during the exercise instead of pushing the ball itself. Arrows A—A of FIG. 1 shows the path of movement of the ball while performing the exercise. The ball is pushed away, and then allowed to swing back, striking a user smartly in the stomach. A few days of this, and one's stomach definitely is toned-up.

The exercise device having this cord adjusting structure therewith offers the additional feature of easy and quick adjustment for different persons which may be using the device. Thus, this embodiment can be quite useful in a gym, health spa, and similar places where many different persons of various heights would be using the same exercise device.

A modification applicable to both of the first and second embodiments is shown in FIGS. 4 and 5. The upper end of the support cord 16, or 16', is attached to the lower end of clamp structure 30. This clamp structure consists of two elements 31 and 33 shaped in the manner of S's as shown in FIG. 4, which are connected together by a pivot pin 34 and have the short portions thereof connected by suitable linkage 36 to an eyelet 32. Eyelet 32 is used for attachment of the upper end of the support cord. The longer portions of the clamp elements members 31 and 33 have at the tips thereof short bars of approximately 3 inches in length which are in the form of flat rectangular strips 35 and 37 for resting upon the upper edge of the normal moldings provided along door frames. While 3 inches is preferred, 1½ to 6 inches have been found to be suitable.

Thus, by using this clamp attachment modification to support the exercise device, a quick and temporary, yet relatively strong attachment to the upper door frame may be made for supporting the exercise device.

With this embodiment, the device is readily portable from one place of use to another, and with very quick and easy set up for immediate use.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to falling within the scope of the invention.

I claim:

1. A stomach exercise and muscle building device comprising:

a relatively heavy weight ball such as a bowling ball, a suspension means for swingingly mounting said ball from an overhead support, means at at least one end of said suspension means for permitting quick and easy height adjustment of the ball to approximately the stomach portion of the body of a person preparing to use the device, said suspension means for swingingly mounting the ball from an overhead support consists of a cord, said adjustment means includes a handle and cleat structure firmly attached to the ball for providing the height adjustment means, in conjunction with one end of the cord attached thereto, wherein said handle and cleat structure consist of an elongated rod having threads at one end thereof and a cord guide eyelet at the other end thereof, an extending handle bar perpendicular to said rod, and two extending diverging prongs forming the cleat structure for receiving the cord therearound during adjustment of the ball height.

2. A stomach exercise and muscle building device as in claim 1, wherein the other end of said cord is attachable to a hook mountable in an overhead structure by a permanent eyelet provided in the other end of the cord.

3. A stomach exercise and muscle building device as in claim 1, wherein the other end of said cord is attached to a quick attachment clamp structure for quick and easy attachment to an overhead structure such as the moldings of a doorframe.

4. A stomach exercise and muscle building device as in claim 3, wherein said clamp structure includes a pair of S-shaped members having a pivot connection therebetween, and attachment means connected to the pair ends opposite said pivot connection for connection to the support cord, and the other pair ends of said members being provided with short, flat bar members for contact and distribution of weight along said moldings.

* * * * *